United States Patent [19]

Roth et al.

[11] Patent Number: 4,498,864

[45] Date of Patent: Feb. 12, 1985

[54] METHOD AND APPARATUS FOR UNIFORMLY DRYING MOVING WEBS

[75] Inventors: Reinhold C. Roth, Newport; Richard F. Terra, Middletown, both of R.I.

[73] Assignee: Techmark Corporation, Newport, R.I.

[21] Appl. No.: 448,619

[22] Filed: Dec. 10, 1982

[51] Int. Cl.[3] ..... F27B 9/28; F26B 19/00; F23D 13/40; F27D 19/00

[52] U.S. Cl. ..... 432/8; 34/48; 431/12; 431/354; 432/37; 432/55; 432/59

[58] Field of Search ..... 432/8, 37, 55, 59; 34/48; 431/12, 354

[56] References Cited

U.S. PATENT DOCUMENTS 3,214,845 11/1965 Huffman ..... 34/48

3,791,049 2/1974 Smith, Jr. ..... 34/48

*Primary Examiner*—John J. Camby

*Attorney, Agent, or Firm*—Louis Weinstein

[57] ABSTRACT

A flame intensity controller for controlling the air/gas mixture introduced into a conveying and/or mixing tube. Plural heating arrays are transversely aligned to the direction of movement to dry the moving web. The controller selectively controls the heating intensity of each section of the heating arrays to thereby control the amount of drying experienced by each longitudinal section of the web. The controller may be a countercurrent air controller or a mechanical restrictor. The energy output of each section is controlled between adjustable upper and lower energy levels. However, the lower energy level is chosen to be sufficient to sustain combustion. The independent control of the dryer sections provides dramatic improvement in uniformity of the moisture "profile" across the web.

38 Claims, 15 Drawing Figures

METHOD AND APPARATUS FOR UNIFORMLY DRYING MOVING WEBS

FIELD OF THE INVENTION

The present invention relates to the process of controlling burner intensity for the purpose of eliminating wet streaks in a moving web of paper or fiber as part of the drying cycle. The invention also relates to the apparatus for controlling the intensity of individual burner elements emitting infrared radiation.

BACKGROUND OF THE INVENTION

A number of applications exist wherein it is desirable to selectively apply heat to a moving web, which is subject to drying by other means, for the purpose of eliminating wet streaks or areas of higher moisture concentration. This process of selectively applying varying amounts of heat across a moving web for the purposes of eliminating moisture variation across the web will hereinafter be termed "profiling". For practical reasons, the energy density must be high to achieve profiling in drying operations. Therefore, fossil fuel burners or emitters are preferred rather than electric energy. The problem then becomes one of controlling the amount of fuel or the amount of combustible gases delivered to individual burners or emitters in such a manner as to effect profile control in increments corresponding to the moisture variations across the web without turning off the burner or emitter.

For example, in the paper making field, paper is produced in the form of an elongated web, which web is comprised of wood pulp saturated with water. The water is removed from the wood pulp by squeezing the wood pulp as it passes between cooperating rollers and further by drying the web formed by the wood pulp through suitable drying means in order to reduce the moisture content to a value with a controlled range. An instrument for detecting moisture content is typically utilized to monitor moisture content of the moving web. The instrument may be located either upstream relative to and/or following the location of the dryer units. The variation in moisture content across the width of the moving web, i.e. in a direction transverse to the direction of movement of the web, frequently presents a serious problem for effectively and efficiently drying the web. To maintain a given moisture range in the final product, the moving web often has to be remoistened and/or overdried, resulting in expensive waste of energy, reduction in machine productivity, increased manufacturing cost and sacrifice of product quality. It is thus extremely desirable to provide apparatus for controlling the web drying operation in a localized manner to obtain the desired moisture range while, at the same time, either eliminating or significantly reducing the above mentioned disadvantages.

BRIEF DESCRIPTION OF THE INVENTION

Controlling individual burner/emitter elements (E) established in a grid consisting of (m×n) elements, as shown in FIG. 6 where (m) denotes the number of columns and (n) the number of rows in the grid, a minimum of one row but more frequently 4–6 rows are used depending on the amount of water that has to be evaporated in order to achieve a levelled moisture profile. The number of columns required is dependent on the width of the web and the size of the individual elements. For example, in a web 120 inches wide, 20 elements could be typically used if the elements were 6 inches wide.

For illustration purposes, it is simple to examine a small grid consisting of 4×5 elements as shown in FIG. 6.

Each burner/emitter E has a maximum output of 100% under normal operating conditions. By restricting the fuel flow to the burner, its energy output can be turned down to about 20% without the risk of flame-out. The turn-down ratio is therefore 80%. Let it further be assumed that the 80% turn-down corresponds to a water evaporation load of 10 lbs/element/hour. Each column thus has the turn-down capability of 40 lbs/h and a maximum evaporation rate of 40/0.8=50 lbs/h. By varying the number of rows that are turned down, it is possible to change the turn-down of each row to be either 40 lbs, 30 lbs, 20 lbs, or 10 lbs. 10 lbs turn-down would thus be achieved by having 3 rows turned down and 1 row fully on.

This particular illustration gives a total turndown of 40 lbs per column in 10 lbs increments. It is also possible to change either the total turn-down by adding or deleting rows to the grid or by decreasing the increment by setting the amount of turn-down to a fraction of the 10 lbs per emitter. If one, for instance, set the turn-down of row 1 to half of the total turn-down or 5 lbs, it would be possible to achieve a total turn-down of 35 lbs in 5 lb increments as follows:

| Row # Turned Down | Pounds of Turn-down |
|---|---|
| 1 | 5 |
| 2 | 10 |
| 1 + 2 | 15 |
| 2 + 3 | 20 |
| 1 + 2 + 3 | 25 |
| 2 + 3 + 4 | 30 |
| 1 + 2 + 3 + 4 | 35 |

By varying the number of rows used and by selecting the proper turn-down fraction for each row, it is possible to vary the drying intensity to accurately match moisture variations across a moving web which is subject to drying to establish a levelled moisture profile. By changing the size of the elements in the cross web direction, it is also possible to vary the resolution of the drying intensity across the web.

The present invention describes two different modes of altering the fuel flow to each burner/emitter in order to achieve the turn-down of the element.

(a) Mechanically restricting the fuel or the air or the fuel/air mixture.

(b) Pneumatically restricting the fuel or the fuel/air mixture by injecting a counter-current airflow downstream of the fuel orifice to serve as a pressure regulating device or achieve a blocking function through the use of an air curtain.

Either method is characterized by the use of a flow blocking device which operates discretely in two different modes, open—high fire or closed—low fire. This approach makes it possible to use simple three-way solenoid actuators to operate the mechanical restrictor or the pneumatic air curtain or pressure control. The solenoid is fast, reliable and minimizes the number of moving parts and the low fire mode provides repeatability and easy flame monitoring and fast temperature response.

The pneumatic restrictor injects a countercurrent air flow into an air/gas mixing chamber or a manifold located downstream of the mixing valve employed for metering/mixing of combustion gas and air. The back pressure created in the mixing chamber by the countercurrent air flow reduces the combustion air flow through the gas/air orifice of the mixing valve. The mixing valve typically utilizes a venturi orifice. The venturi action in the orifice, created by the air flowing past the venturi establishes a vacuum which accurately meters the gas drawn into the mixing chamber. The back pressure established by the introduction of the countercurrent air flow through a control inlet, which counter-current air flow is of greater pressure than the pressure of the combustion gas/air mixture in the mixing chamber, reduces the flow of combustion gas passing through the venturi orifice, which in turn meters less gas into the mixing chamber.

By varying the flow of countercurrent air into the mixing chamber, the intensity of the burner can be varied continuously from high to low fire without the need for shutting off the burner completely, which would then require automatic reignition and flame monitoring for individual burners. A complete shut-off is disadvantageous since it also increases the heat-up period of the burner.

The benefits of utilizing a reverse flow obtained through an air jet for changing the burner intensity reside in the ability to achieve continuous ignition and the elimination of unnecessary mechanical parts and in the safety of utilizing an air stream as a means of control. In one preferred embodiment, a solenoid valve can be utilized to control the flow of the air jet for switching between two discrete positions, viz., full fire and low fire. The air pressure of the air supply used to supply the reverse flow air jet is higher than that of the mixing chamber to prevent leakage of combustion gases back into the air supply line of the air jet.

The operation of the solenoids for the countercurrent air jet can be controlled manually to change the flow rate or can be controlled automatically by control means which may include a microprocessor which, in turn, can be interfaced with a scanning moisture measuring device. The latter technique is extremely useful in moisture profiling applications, as will be more fully described.

The countercurrent air flow nozzle may be designed to achieve countercurrent turbulence to directly alter the venturi effect and thereby reduce the ratio of the gas/air mixture. The countercurrent air flows can be utilized in a variety of different mixing chambers and/or gas/air mainifolds.

The mechanical restrictor utilizes a pneumatically operated solenoid having a needle valve which is driven a predetermined distance into an opening provided in the mixing valve which receives the combustible gas. The depth of entry of the needle valve into the opening determines the amount of restriction. Depth may be controlled by placement of washers of different thickness or of a different number of washers of uniform thickness within the piston cylinder to control the entry depth of the needle valve into the mixing valve opening.

Alternatively, the restrictor may comprise a solenoid operated shutter which provides a larger (full flame) or smaller (pilot flame) opening for controlling the air/gas flow and hence the heat intensity of the burner.

A plurality of emitter assemblies may be utilized and control means for selectively operating the sectional units of these assemblies can be provided to accurately control the desired amount of drying (i.e. moisture reduction) by selective operation of each of the individual sectional units making up each assembly to thereby dry elongated sections of the paper web. For example, four such assemblies may be arranged at spaced parallel intervals and transverse to the path of movement of the web. Each assembly is comprised of a plurality of sectional units. Each of the rows of air/gas mixing devices may be preadjusted to reduce moisture content by predetermined fractions of moisture reduction. As one example, the moisture content of the web may be reduced over a range of one-quarter percent to two and three-quarter percent at one-quarter percent increments.

The invention is extremely useful for "profiling". For example, when the moisture content profile across the web indicates that the web has a nonuniform moisture content and/or moisture content which departs significantly from a preferred moisture content, the individual sections of the emitter assemblies may be selectively controlled by the countercurrent air flow provided at the control inlet of each dryer unit section. The independent control of each dryer unit section provides a superior corrective adjustment of localized departures from the target moisture value at a significant reduction in total energy requirements.

The control inlet for communicating the air jet with the mixing chamber may be designed to provide an air curtain having a "fishtail" shape for blocking the gas/air flow in addition to regulating the countercurrent flow. Other shapes of air blast may be provided if desired. The air jet velocity may be adjusted to provide either turbulent or laminar flow. The mechanical restrictors may be used in place of the pneumatic restrictors with equal success.

OBJECTS OF THE INVENTION AND BRIEF DESCRIPTION OF THE FIGURES

It is, therefore, one object of the present invention to provide novel method and apparatus for substantially improving the uniformity of moisture content across a moving web subjected to drying by selectively regulating individual drying units arranged in one or more rows extending across the moving web.

Still another object of the present invention is to provide a method and apparatus of the type described hereinabove wherein regulation of the individual dryer units is performed in such a manner as to avoid total turn-off of any individual unit.

Another object of the present invention to provide novel control means for regulating the delivery of a gas/air mixture to a combustion region through the use of countercurrent air flow.

Still another object of the present invention is to provide apparatus for regulating the flow of an air/gas mixture moving through a mixing chamber, or the like, toward a combustion region by means of a countercurrent air flow manifested by an air blast introduced into the mixing chamber by an air control inlet means downstream of the air/gas mixing means.

Still another object of the present invention is to provide apparatus for regulating the flow of an air/gas mixture through a mixing chamber, or the like, toward a combustion region by means of a countercurrent air flow manifested by an air blast introduced into the mixing chamber by an air control inlet means and further comprising an air regulator solenoid for regulating the introduction of the countercurrent air blast into the mixing chamber for controlling the level of burning.

Still another object of the present invention is to provide apparatus for regulating the flow of an air/gas mixture through a mixing chamber, or the like, for controlling the energy output of the air/gas mixture through the utilization of mechanically operated flow control means.

Still another object of the present invention is to provide apparatus for regulating the flow of an air/gas mixture through a mixing chamber, or the like, for controlling the energy output of the air/gas mixture through the utilization of mechanically operated flow control means, wherein said control means comprises reciprocally movable needle valve means arranged to be selectively inserted into the gas inlet opening of an air/gas mixing valve.

Still another object of the present invention is to provide novel regulating means for controlling the flow of an air/gas mixture into a combustion region through a mixing chamber or the like for reducing the moisture content of a moving web.

Still another object of the present invention is to provide a dryer unit embodying the principles of the present invention in which the countercurrent air flow introduced into the dryer unit mixing chamber or the like is controlled by means including a moisture detection instrument.

Still another object of the present invention is to provide a novel system for drying moving webs and the like comprised of a plurality of drying units each utilizing the countercurrent air flow principle of the present invention for regulating the gas/air mixture delivered to the combustion region of the dryer and including control means for selectively controlling the countercurrent air flow of each dryer unit to regulate the percent of moisture reduction over a predetermined range within preset increments.

Still another object of the present invention is to provide a novel system for providing for more uniform drying of a moving web by controlling the energy output of the individual drying units through mechanical means to substantially improve the uniformity of moisture content across the moving web.

Still another object of the present invention is to provide countercurrent controls responsive to a moisture profile across a moving web for making localized adjustments in moisture content to bring the moisture profile within desired limits and at a significant reduction in expended energy.

The above, as well as other objects of the present invention, will become apparent when reading the accompanying description of drawings in which.

Figure 2:
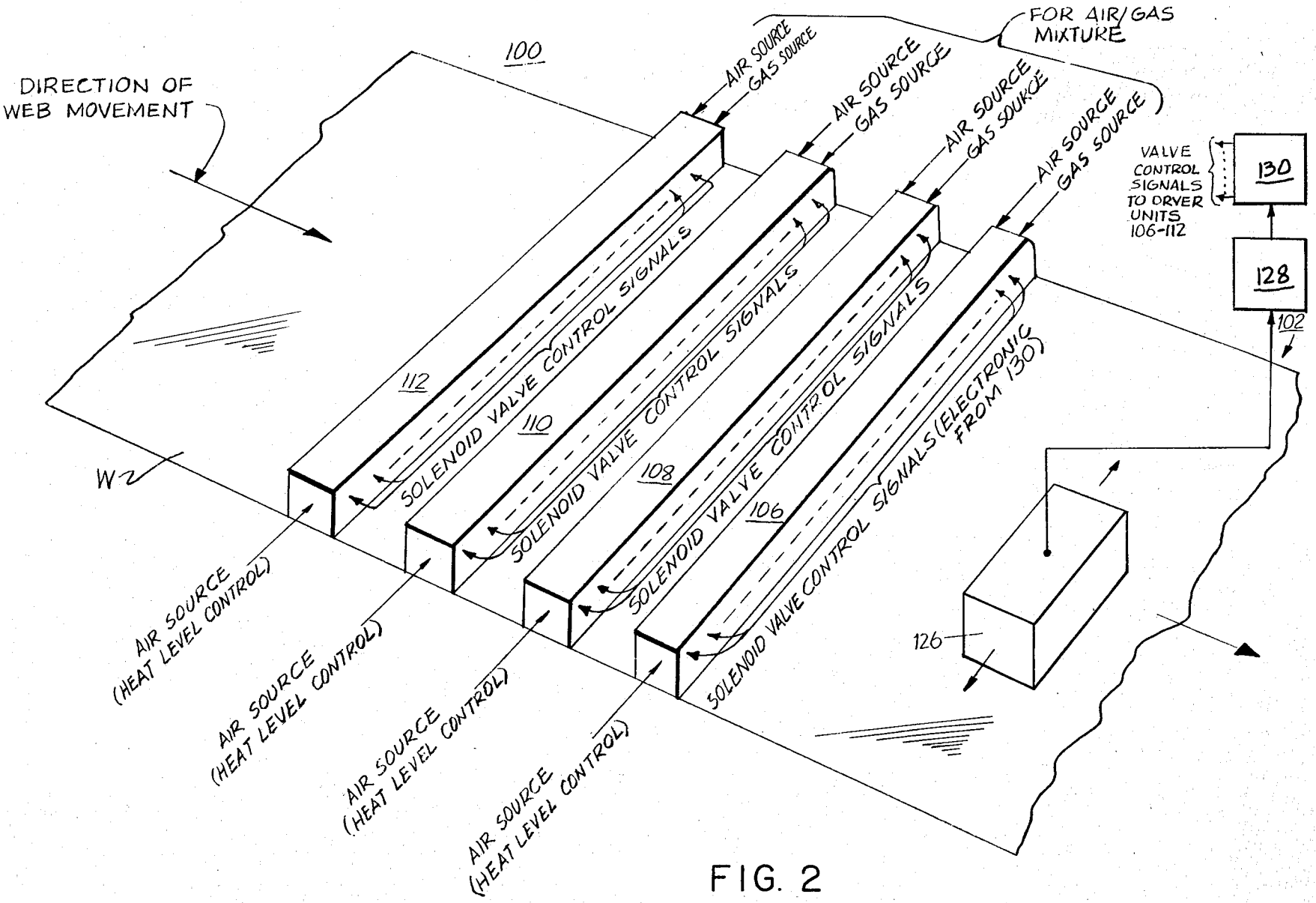
FIG. 2 shows a simplified perspective view of a system employing a plurality of drying units embodying the principles of the present invention.
Figure 2A:
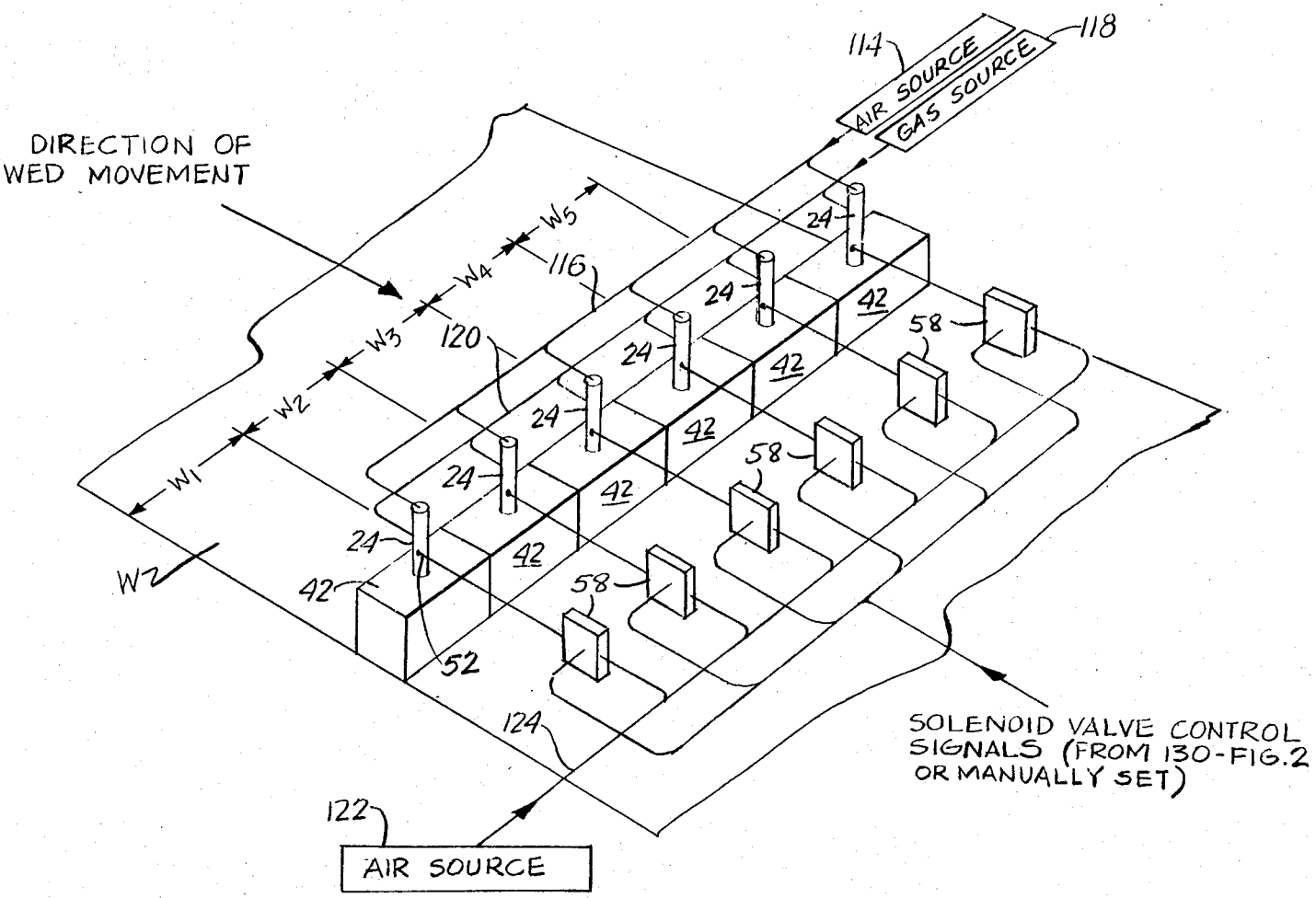

FIG. 2*a* is a perspective view showing one of the dryer units of FIG. 2 in greater detail.

Figure 3A:
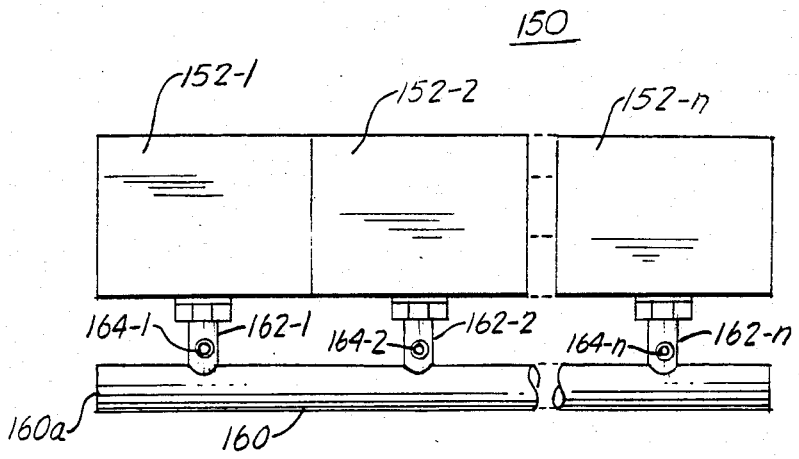
Figure 3B:
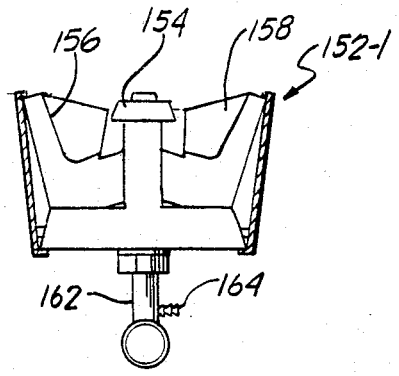

FIGS. 3*a* and 3*b* show side and end views respectively of another type of dryer unit utilizing the principles of the present invention.

Figure 4B:
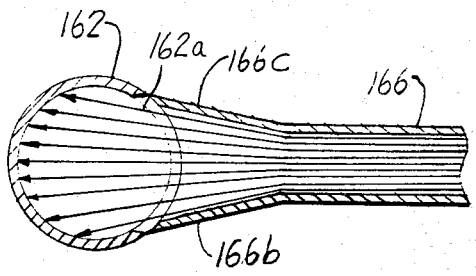
Figure 4A:
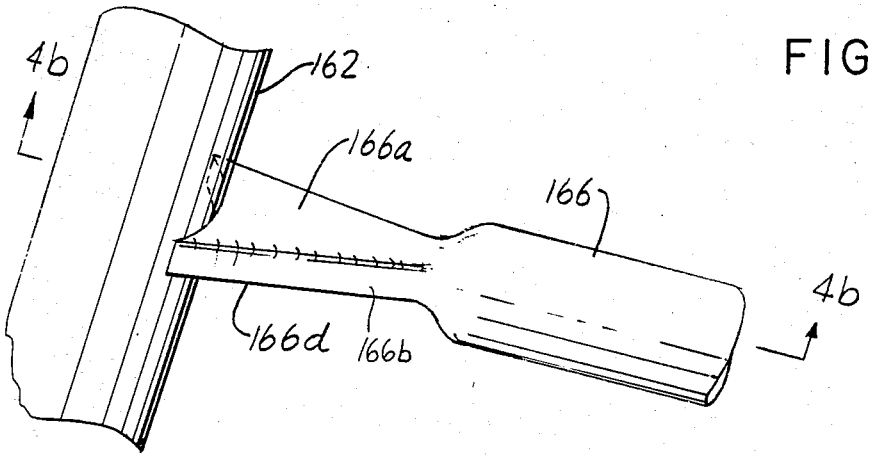

FIGS. 4*a* and 4*b* show perspective and sectional views, respectively, of another preferred embodiment of the present invention.

Figure 5A:
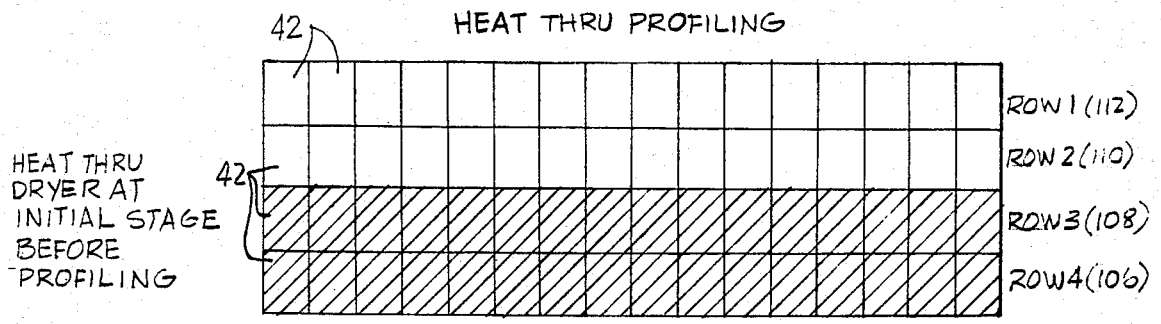
Figure 5B:
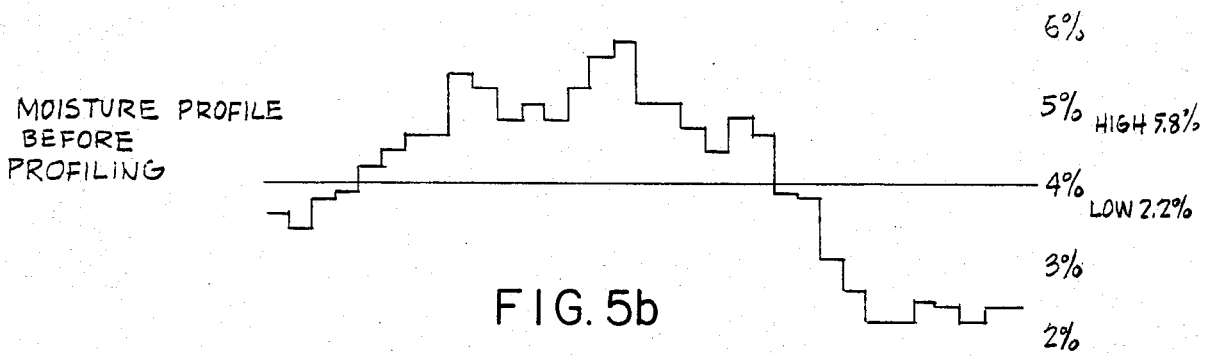
Figure 5C:
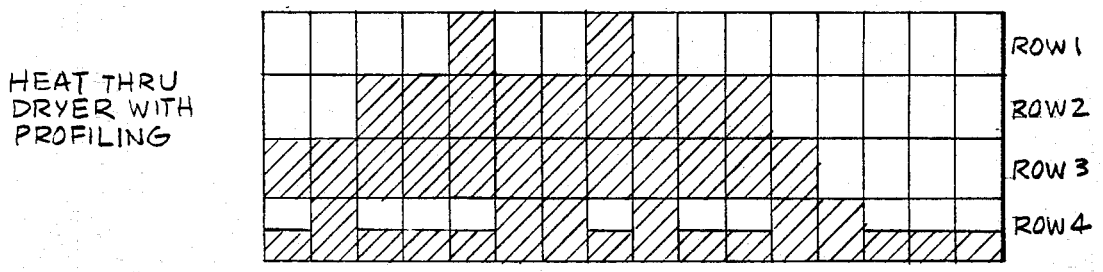

FIGS. 5*a* and 5*c* respectively show diagrams of the heating system before profiling and with profiling responsive to a given moisture profile.

Figure 5D:
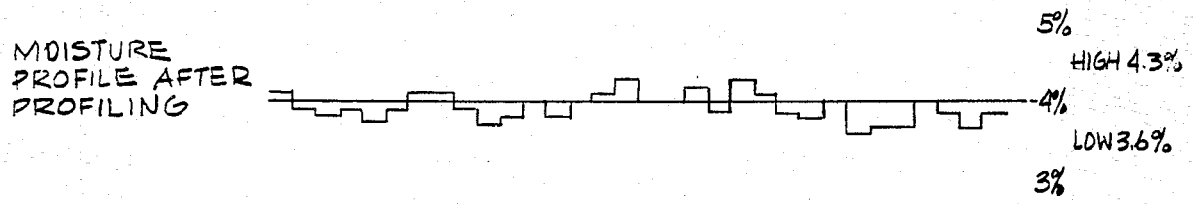

FIGS. 5*b* and 5*d* respectively show a moisture profile across a web before profiling and after profiling.

Figure 6:
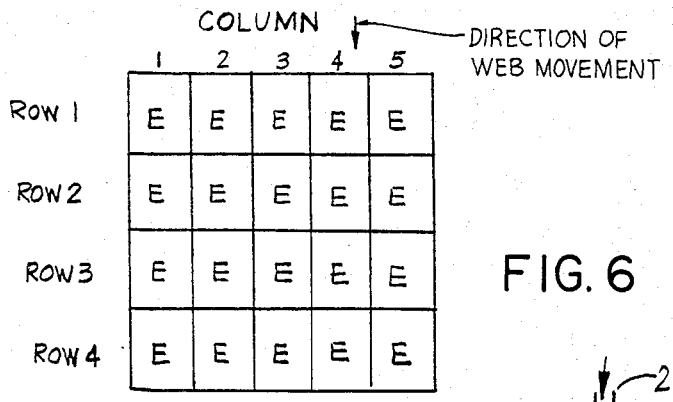

FIG. 6 shows a diagram of another simplified profiling system useful in understanding the present invention.

Figure 7B:
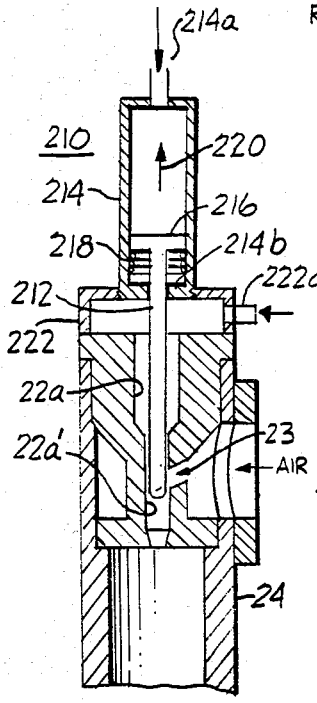
Figure 7A:
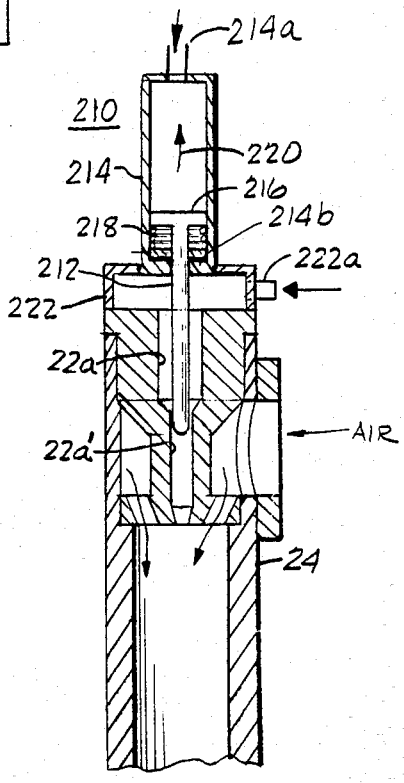
Figure 7:
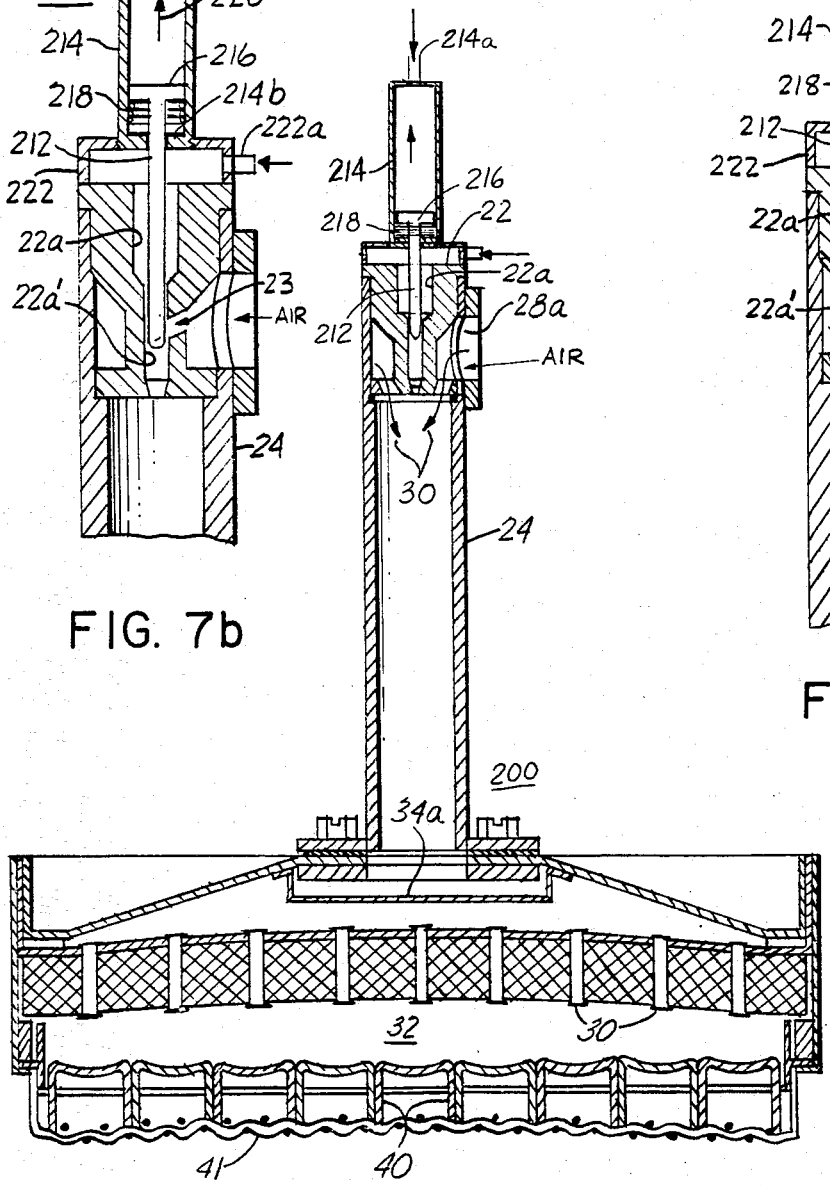

FIG. 7 shows a sectional view of another alternative embodiment of an infrared burner for use in the profiling system of the present invention.

FIG. 7*a* shows a detailed view of the mixing valve and mixing chamber of the burner unit shown in FIG. 7.

FIG. 7*b* is a sectional view of an alternative embodiment for the mixing valve shown in FIG. 7*a*.

DETAILED DESCRIPTION OF THE INVENTION AND THE PREFERRED EMBODIMENTS THEREOF

Figure 1:
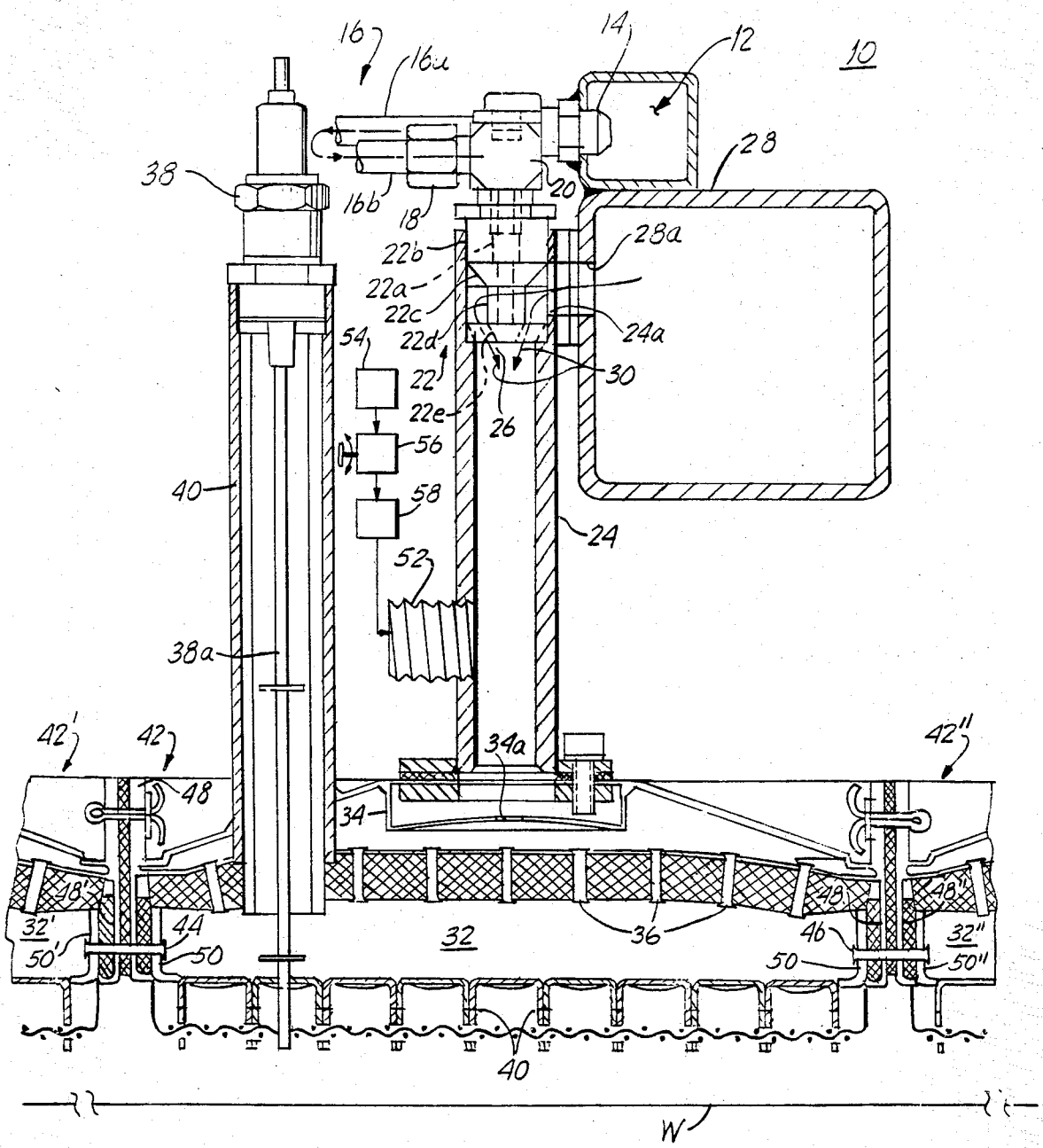
FIG. 1 shows a portion of a dryer unit embodying the principles of the present invention.

FIG. 1 shows a portion of a drying unit 10 embodying the principles of the present invention and comprised of a gas supply manifold 12 receiving a combustion gas from a combustion gas supply source (not shown) and for delivering the combustion gas through manifold 12 and coupling 14 to a hollow conduit 16 which may, for example, be a U-shaped tube having an arm 16*a* and an arm 16*b*, the yoke portion of the conduit 16 being omitted from FIG. 1 for purposes of simplicity. Conduit portion 16*b* delivers the combustion gas through coupling 18 to an L-shaped coupling 20 for introducing the combustion gas into the venturi orifice 22*a* of a venturi type mixing valve 22. Mixing valve 22 is airtightly fitted within the upper opening provided in mixing chamber 24. Mixing valve 22 is provided with a tapered intermediate portion 22*c* which tapers from a large diameter portion 22*b* to a small diameter portion 22*d*. The free end of small diameter portion 22*d* is tapered at 22*e*. A cylindrical disk 26 is provided with diagonally aligned openings surrounding tapered portion 22*e*. A portion of the hollow region between mixing valve 22 and mixing chamber 24 is arranged to receive air introduced through an opening 24*a* in mixing chamber 24 and an opening 28*a* in an air supply manifold 28 for delivering air under pressure to the mixing chamber. Air under pressure is introduced through openings 28*a* and 24*a* and flows about the exterior portion of mixing valve 22 and downwardly into the hollow exterior of mixing chamber 24, as shown by arrows 30. The air passing the venturi orifice 22*a* creates a vacuum condition which draws combustion gas through the orifice and into mixing chamber 24 in a controlled and measured amount. The gas/air mixture continues to move downwardly and into a combustion chamber 32, passing through an opening 34*a* in a member 34 and through a plurality of hollow, cylindrically shaped elements 36 to enter into the combustion chamber 32. The elements 36 are arranged within a wall formed of a suitable insulation material to provide a plurality of orifices for introducing the air/gas mixture into the combustion chamber.

A spark ignitor 38 is arranged within hollow, cylindrical member 40, the centrally located electrode 38*a* extending into combustion chamber 32 to develop a spark for igniting the air/gas mixture within combustion chamber 32. Burning takes place in chamber 32 in order to heat the substantially U-shaped radiating elements 40. The combusted air/gas mixture heats elements 40 causing them to emit heat radiation in the infra-red range.

Burning is sustained by continuous flow of the air/gas mixture into the combustion chamber 32.

The dryer unit 42 is positioned above a moving web W which web is moving, for example, in a direction out of and perpendicular to the plane of FIG. 1. Units 42' and 42'' are substantially identical to the infrared emitter unit 42, and are arranged in an end-to-end manner. The emitter units 42' and 42'' are joined to unit 42 by pins 44, 46 extending through openings in the walls 48, 50 of unit 42, as well as the walls 48', 50' and 48'', 50'' of the infrared emitter units 42' and 42'', respectively.

In order to regulate the flow of the air/gas mixture which is delivered to combustion chamber 32 through the mixing chamber 24, chamber 24 is provided with a control inlet 52, preferably in the form of a hollow externally threaded member, for coupling a second air supply 54 therethrough, preferably through an adjustable valve 56 and a solenoid controlled valve 58.

The air pressure developed by source 54 is substantially greater than the pressure within air/gas mixing chamber 24 to prevent the passage of the air/gas mixture through inlet 52 and back to source 54.

Adjustable valve 56 may be adjusted to regulate the flow of air from source 54. Solenoid control valve 58, in one preferred embodiment of the invention, is comprised of a solenoid operated, two position valve assembly, having a first position which is normally closed to prevent the passage of air from source 54 into control inlet 52 and likewise to prevent the air/gas mixture in mixing chamber 24 from passing through inlet 52 and toward source 54.

By energizing the solenoid of the solenoid control valve assembly 58, the valve is moved to the open position to allow a jet of air from source 54 to pass through adjustable valve 56, open solenoid valve 58 and inlet 52 into mixing chamber 24.

The introduction of a jet of air into mixing chamber 24 through control inlet 52 develops a back pressure condition resulting from the countercurrent air flow of greater pressure than that of the combustion gas/air mixture to reduce the venturi effect and thereby causing the gas/air mixing valve 22 to meter less gas through orifice **22*a* and into mixing chamber 24. The reduction in the proportions of air and gas in the air/gas mixture due to the back pressure developed in mixing chamber 24 reduces the burning and heating level within combustion chamber 32 to thereby reduce the intensity of infrared radiation emitted from the radiating surfaces 40, the amount of reduction in heat intensity being a function of the pressure level of air pressure source 54 and the adjustment of adjustable valve 56**.

Care must be exercised in the selection of the size of inlet opening 52. If the opening is too small, the velocity of air jet moving through inlet 52 will be too great. This will create a vacuum effect causing more, rather than less, gas to be drawn into the mixing chamber through the venturi. It appears that turbulent air flow creates the undesirable vacuum condition whereas lamilar air flow blocks the flow of the air/gas mixture in the region of the countercurrent air jet.

The moving web, which may be paper, cloth or any other material, is preferably monitored by a moisture level detection instrument 102 having a moisture detecting head 126 (see FIG. 2). The moisture detector apparatus may, for example, be of the type described in U.S. Pat. No. 3,458,808 issued July 29, 1969 or U.S. Pat. No. 3,829,754 issued Aug. 13, 1974 as exemplary of satisfactory moisture detection devices which utilize microwave detection cavities. However, any other type of moisture detection device may be utilized including manual observation. A moisture level is thus detected and, if this moisture level is not within a desired moisture level range, control logic 128 coupled to the moisture detecting head 126 is utilized to close solenoid 58 to provide radiation intensity at a level sufficient to reduce the moisture content of the web to an acceptable level. In the event that the moisture level content lies below the desired range, detector instrument 102 develops a signal which opens normally closed solenoid 58 to significantly reduce the intensity (drying) level since the web is below the desirable moisture content level. The lower intensity level is preferably sufficient to provide only minimal drying while avoiding the need for reignition of the air/gas mixture.

The detector head 126 (see FIG. 2) may be comprised of a plurality of independent detector heads, each capable of measuring moisture content over a portion of the width of web W.

Alternatively, a single scanning head may be employed. The single scanning head 126 may be comprised of only one detector head which scans across the width of the web W. A moisture reading is taken at discrete intervals of the scan (i.e. movement) of the single detector head across the web.

As one example of moisture level control, let it be assumed that the desired average moisture content across web W should be of the order of six percent. Considering FIG. **2*a*, let it further be assumed that the portions W, $W_3$ and $W_5$ of the web W have a moisture content of the order of six percent; that the portion $W_2$ of the web W has a moisture content of the order of five percent and that a portion $W_4$ of the web has a moisture content of the order of nine percent. The average of these moisture contents exceeds six percent, which is the desired average. By utilizing a dryer unit having dryer sections whose air/gas mixtures are adjusted to reducing the moisture content in the associated section of the web by two percent, the moisture content can locally be reduced in section $W_4$ sufficiently to bring the average moisture content across the web below the desired six percent average value. This may, for example, be accomplished through the use of a dryer unit having sections 42 whose combustion gas/air mixtures are each adjusted to provide a marginal reduction in moisture content when the solenoid valve 58 is opened to reduce the intensity of the flame. Each dryer unit section 42 is further capable of being operated to provide a two percent reduction in moisture content by closing the solenoid valve 58 to thereby increase the flame intensity. The heat intensity (i.e. drying level) is further adjustable by controlling the pressure level of the air pressure source 54 and further by controlling the adjustment of regulating valve 56 (either manually or automatically), as shown in FIG. 1**. Thus, the moisture profile is thus readjusted to an acceptable profile at a significant saving in energy consumption.

The arrangement 100 of FIG. 2 employs a plurality of dryer units 106, 108, 110 and 112, arranged in spaced parallel fashion and extending transversely across moving web W. The drying units 106 through 112 are each comprised of a plurality of dryer unit sections 42 which may be of the infrared emitter type 42 shown in FIG. 1, or may be any other suitable type of dryer heated by an air/gas mixture. The size of each unit in the cross direction of the web is preferably small, such as 6" or so, to improve monitoring in the cross direction of the web.

FIG. 2 shows the dryer units in simplified diagrammatic fashion. FIG. 2*a* shows one typical unit 106 comprised of sections 42 each having a mixing chamber 24 receiving air (for combustion) from air source 114 through line 116 and receiving gas from gas source 118 through line 120. Each control inlet 52 receives air under pressure (for control) from air source 122 through line 124. Valves 58 are electrically controlled by signals from control unit 130 (FIG. 2) which receives moisture content signals from the signal output portion 128 of scanning head 126 or from a manual input. The dryer units 108–112 are substantially identical to unit 106.

The electronic control unit 130 operating solenoid control valves may incorporate a microprocessor.

The operation of the dryer system in FIG. 2 is as follows:

FIGS. 5*a*–5*d* illustrate the use of the profiling system on a typical paper machine operating to move the web W in the speed range of 1200–1800 fpm. In the example shown in FIGS. 5*a*–5*d*, the system consists of 4 rows of burner units 106–112, each unit being comprised of sections 42, measuring 4"×6" in size. Each burner section 42 can be individually controlled to a high or low heat intensity. The difference between the two levels is the "turndown". Rows 1–3 have been set to yield a turndown (reduction) of 1% final moisture, whereas Row 4 has a turndown of ½% to allow for moisture control in ½% increments. The total turndown for this illustration is therefore 3½%. This means a correction capability of +2%; −1½% around a desired moisture target.

The dryer system 100 is initialized with 50% of its capacity turned-on (see FIG. 5*a*). The moisture profile at reel (i.e. where the paper web is wound up) measured by scanning head 126 shows a typical profile variation (see FIG. 5*b*) which requires a moisture target of 4% in order not to exceed a maximum of 6%. Each rectangle in FIGS. 5*a* and 5*c* represents a dryer section 42. A shaded rectangle represents a section which is "ON" (i.e. high heat) while an unshaded rectangle represents a section which is "OFF" (i.e. low or marginal heat).

The sections 42 of the dryer system 100 are readjusted as shown in FIG. 5*c* to provide differential drying based on the moisture content profile shown in FIG. 5*b* either as measured by the scanning moisture head or as determined by an operator. The resulting final profile is shown in FIG. 5*d* as being tightly clustered around the original moisture target of 4%.

The paper web can then be run faster or the amount of steam consumed in the paper making process can be reduced to increase the final moisture target from 4% to 5½% resulting in substantial steam and fiber savings and allow a machine speed-up. This technique of providing localized corrections in the moisture profile also results in a significant reduction in fuel (i.e. gas) consumption.

Obviously, any other adjustments may be made to provide the desired incremental reduction in moisture content and/or a greater or lesser number of drying units may be provided depending upon the needs of the particular application. Some other examples are given in the folowing chart.

OTHER TYPICAL REDUCTIONS

| | Increments | | | |
|---|---|---|---|---|
| Burner Units | ¼% | ⅓% | ½% | 1% |
| 1 | ¼ | ⅓ | ½ | 1 |
| 2 | ½ | ⅔ | 1 | 1 |

-continued

OTHER TYPICAL REDUCTIONS

| | Increments | | | |
|---|---|---|---|---|
| Burner Units | ¼% | ⅓% | ½% | 1% |
| 3 | 1 | 1 | 1 | 1 |
| 4 | 1 | 1 | 1 | 1 |
| Total: | 2¾% | 3% | 3½% | 4% |

FIGS. 3*a* and 3*b* show another alternative arrangement wherein an assembly 150 is comprised of a plurality of individual heating units 152-1 through 152-n, each unit incorporating an elongated burner head 154 (shown in FIG. 3*b*) for heating a suitable refractory 156, 158 which provides a high rate of radiant heat transfer. Each unit receives an air/gas mixture which is introduced into the inlet end 160*a* of manifold 160 and is delivered to each unit through the branch conduits 162-1 through 162-n. Each branch conduit 162 is provided with a control inlet 164-1 through 164-n for introducing air from the supply source such as, for example, the supply source shown in FIG. 1, into each branch conduit in order to provide a back pressure. The coupling connected to one of the conduits 162 may be shaped in the manner shown in FIGS. 4*a*, 4*b* in order to create a "fishtail" shape air curtain within conduit 162. Noting FIG. 4*a*, an air supply conduit 166 is provided with a narrowing exit portion 166*a* which narrowing exit portion flares outwardly as defined by the sidewalls 166*b*, 166*c* (shown in FIG. 4*b*) and the triangular shaped walls 166*a*, 166*d* (shown in FIG. 4*a*). This outlet communicates with an arcuate shaped opening 162*a* in conduit 162 to cause a narrow, "fishtail" shape air curtain to be introduced within the interior of conduit 162 (see FIG. 4*b*) for blocking the gas/air flow in addition to regulating the countercurrent flow, i.e. the back pressure condition created in the region of the venturi orifice.

FIGS. 7 and 7*a* show an alternative arrangement for regulating the air/gas mixture wherein like elements are designated by like numerals, as compared with FIGS. 1 and 7. The unit 200 comprises mixing valve 22 provided with central opening 22*a*, which selectively receives the reciprocating needle member 212 of a pneumatically driven assembly 210 comprised of housing 214 with an air inlet opening 214*a* for receiving air under pressure. Needle member 212 is joined to piston 216 arranged within cylinder 214. A return spring 218 is arranged between piston 216 in the bottom end 214*b* of cylinder 214. Return spring 218 normally urges piston 216 upwardly in the direction shown by arrow 220. Gas enters into a closure cap 222 having a gas inlet opening 222*a* and passes through an annular path described by needle 212 and central opening 22*a*. When no air under pressure is applied to the control inlet opening 214*a*, return spring 218 urges piston 216 and needle 212 upwardly, allowing unrestricted (maximum) gas flow to provide a rich gas/air mixture in mixing chamber 24. Application of air under pressure to control inlet opening 214*a* urges piston 216 and needle 212 downwardly to extend more deeply into opening 22*a* and the reduced diameter portion 22*a*' thereof, thereby reducing the amount of gas entering into mixing chamber 24 and providing a leaner gas/air mixture which reduces the energy output of the burner. However, a sufficient amount of gas is introduced into the mixing chamber to sustain combustion and thereby avoid the necessity of initiating a start-up. The depth of entry of needle 212 into mixing valve opening 22*a* may be controlled by placing washers within cylinder 214 and between piston 216 and the lower end, 214*b* of cylinder 214 or between cylinder housing 214 and the top of closure cap 222, or by adjusting the height of cylinder housing 214 relative to closure cap 222, thus limiting the depth of penetration of the needle 212 into opening 22*a*. The washers may either be of varying thickness or may be of one uniform thickness with the number of washers introduced controlling the overall depth reduction. The arrangement shown in FIGS. 7 and 7*a* may be utilized with equal success in any of the dryer units described hereinabove and as a substitute for the countercurrent gas flow control means shown, for example, in FIGS. 1, 2, 3 and 4. The air introduced into cylinder inlet 214*a* may be regulated by a solenoid controlled valve 215.

Instead of applying needle member 212 to the flow of gas alone as shown in the above arrangement, an alternate arrangement as shown in FIG. 7*b* employs a needle member 212' of extended length to also control the flow of combustion air 30 or to regulate a mixture of gas and air as shown in arrangement 150 of FIGS. 3*a* and 3*b* by replacing the air flow device by a mechanical needle device of the type shown in FIG. 7*b*.

An additional variation may employ a solenoid blocking valve directly on the mixing tube (162) or (24), such blocking valve having an orifice opening in the blocking diaphragm to allow passage of a lesser amount of combustible gas in the blocked or closed position. The blocking valve may be in the form of a shutter movable to a first position to provide a large opening (full flame) and a second position to provide a restricted opening (pilot flame).

Since water layers of the type considered in this application have their maximum infrared absorption in the wavelength region of 1.9 to 1.95 microns, it is highly advantageous to control the infrared emitters to operate in this portion of the infrared spectrum to the greatest extent possible. The present invention capitalizes on this phenomenon, since only some (but not all) of the emitters E in a column (see FIG. 6) are turned down while the remaining emitters of the column are operated at high fire, corresponding to the optimum wavelength. An alternative way to make intensity adjustments to a column having one long emitter would be to adjust the intensity of the entire column by conventional means, i.e., butterfly valves. As an example, a 50% turndown of a column would mean that, using the grid approach of the present invention, two out of four emitters E in a column would be in low fire, whereas the remaining burners would be operating at high fire, thus operating at their highest efficiency. A conventional control system would turn down a column emitter to a 50% level, moving the emitter out of the preferred wavelength range, which results in enormous fuel inefficiency.

Although the present invention is described as being extremely useful for heater and dryer units, and for heater and dryer units of the infrared type, it should be understood that the present invention may be utilized in any application wherein it is desired to alter an air/gas mixture automatically and without either having to shut-off the burner completely or, alternatively, without having to readjust the controls utilized with the lines coupling the combustion gas and air supply sources to the mixing valve and mixing chamber.

A latitude of modification, change and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein.

What is claimed is:

1. Apparatus for regulating an air/gas mixture delivered to a combustion chamber comprising:

a conduit having a first inlet for receiving an air/gas mixture and an outlet; said conduit delivering an air/gas mixture entering said inlet to said outlet;

said outlet communicating with said combustion chamber;

a control device in said conduit intermediate said inlet and said outlet and communicating with the interior of said conduit;

a source of air under pressure;

delivery means for delivering air from said source to said control device; and said delivery means including regulating means for regulating the flow level of air from said source to said control device whereby the intensity of the flame produced by the air/gas mixture in the combustion chamber is a function of the flow level delivered to said control device from said source.

2. The apparatus of claim 1 wherein the air/gas mixture introduced into said first inlet contains air and a combustible gas mixed in predetermined proportions.

3. The appartus of claim 1 wherein said regulating means comprises valve means.

4. The apparatus of claim 1 wherein said regulating means comprises manually adjustable valve means.

5. The apparatus of claim 1 wherein said regulating means comprises solenoid controlled valve means.

6. The apparatus of claim 1 wherein the pressure level of said pressure source is greater than the pressure level of the air/gas mixture entering into said inlet.

7. The apparatus of claim 1 wherein a mixing valve delivers an air/gas mixture to said first inlet; and said regulating means being adjustable to develop a back pressure in the region of said mixing valve to reduce the flow of gas and combustion air through said mixing valve.

8. The apparatus of claim 7 wherein said mixing valve includes a venturi orifice.

9. The apparatus of claim 1 further comprising:

a source of a combustible fuel gas;

a source of combustion air under pressure;

a hollow mixing chamber;

a mixing valve in said mixing chamber, said valve having a central opening communicating said gas supply with said mixing chamber;

said mixing chamber having a combustion air supply opening communicating said air supply with the interior of said hollow mixing chamber; and the outlet end of said mixing valve extending into said mixing chamber and being tapered to allow the flow of air entering said air supply opening and passing said outlet end to draw gas through said valve opening and into said mixing chamber where said air and gas flows are mixed as they pass through said mixing chamber.

10. The apparatus of claim 1 wherein said control device includes an inlet provided with a tapered portion for causing air under pressure introduced into the narrow end of said tapered portion to be dispersed in a fan shaped fashion to enter into an arcuate shaped opening in said conduit to create a fishtail shape air curtain within said conduit when said second air supply source is coupled to said tapering portion.

11. The apparatus of claim 1 wherein said control device comprises an inlet provided with means for causing air introduced into said control device inlet to form a fishtail shaped air curtain within said mixing chamber for blocking the flow of the air/gas mixture.

12. The apparatus of claim 1 wherein said control device comprises an inlet provided with means for causing air introduced into said control inlet to form a fishtail shaped air curtain within said mixing chamber for blocking the flow of the air/gas mixture, in addition to introducing back pressure into the region of said mixing valve.

13. The apparatus of claim 1 further comprising moisture detection means; and control means responsive to said moisture detection means for controlling said regulating means to regulate the burning in the combustion chamber.

14. The apparatus of claim 1 wherein the velocity of the air delivered to said control device is adjusted to provide a laminar air flow in said mixing chamber to enhance the ability of the air jet to regulate the air/gas mixture flow through said conduit.

15. A drying system comprising:

means for moving a web along a path extending through a drying station;

said drying station comprising a plurality of elongated drying means each extending transverse to the path of movement of said web;

said drying means being arranged at spaced intervals along the path of said moving web;

each of said drying means comprising side-by-side dryer sections each arranged to be heated by a flame sustained by an air/gas mixture;

a gas supply;

a first combustion air supply;

an air/gas mixing chamber for each dryer section for communicating with said air supply and said gas supply for mixing air and gas entering said mixing chamber and delivering the air/gas mixture to the heating means of each dryer section;

means for igniting said air/gas mixture to heat each of said drying sections;

regulating means for selectively controlling the air/gas mixture entering said mixing chamber whereby the heat intensity of said drying sections are regulated between a high and a low intensity level to selectively control the amount of drying experienced across said moving web by each drying means whereby maximum drying for each longitudinal web section is obtained when the drying sections of all of said drying means associated with said longitudinal section of the web are controlled to provide high intensity heating and for incrementally reducing the total amount of drying for each longitudinal section by selectively operating the control means associated with each drying section.

16. The apparatus of claim 15 further comprising moisture measuring means for measuring moisture content to determine the moisture profile across the moving web;

means responsive to the moisture profile for selectively operating the control means of each dryer section to maintain the moisture profile within predetermined limits.

17. The apparatus of claim 15 wherein the high intensity level of each drying station is independently adjustable to vary the drying over either smaller or larger drying increments.

18. Apparatus for regulating an air/gas mixture delivered to a combustion chamber comprising:

a plurality of conduits each having an inlet coupled to the manifold for receiving an air/gas mixture and an outlet; each of said conduits delivering an air/gas mixture entering its associated inlet to its associated outlet;

said outlets communicating with said ignition chamber;

a control inlet in each of said conduits being arranged intermediate the inlet and outlet of said conduits and communicating with the interior of said conduits;

a source of air under pressure;

delivery means for delivering said source to each of said control inlets;

said delivery means including regulating means for regulating the flow level of air from said source to each of said control inlets whereby the intensity of the flame produced by the air/gas mixture in the ignition chamber is inversely proportional to the flow level delivered to said control inlet from said source.

19. A method for retaining the moisture profile across a moving paper web within a desired range comprising the steps of:

moving the web past a dryer unit comprised of dryer sections arranged side-by-side and spanning across the width of the web; each section having a mixing chamber for delivering an air/gas mixture to the heating elements thereof, each mixing chamber having a mixture controller;

measuring the moisture content across the web to provide a moisture profile;

selectively operating the mixture controller to increase the output energy of only those drying sections associated with the longitudinal sections of the web whose moisture profile is above a predetermined level.

20. A method for retaining the moisture profile across a moving web within a desired range comprising the steps of:

moving the web past a plurality of dryer units each comprised of dryer sections arranged side by side and spanning across the width of the web, each section having a mixing chamber for delivering an air/gas mixture to the heating elements thereof, each mixing chamber having a mixture controller, said dryer units being arranged in spaced parallel fashion;

measuring the moisture content across the web to provide a moisture profile;

selectively operating said mixture controllers to increase the output energy of those drying sections of the drying units associated with longitudinal sections of the web whose moisture profile is above a predetermined level.

21. Apparatus for regulating an air/gas mixture delivered to a combustion chamber comprising:

a conduit having a first inlet for receiving an air/gas mixture and an outlet, said conduit delivering the air/gas mixture entering said inlet to said outlet;

said outlet communicating with said combustion chamber;

a mixing device having a first inlet for receiving gas, a second inlet for receiving air and a mixing region for mixing said air and gas and delivering the mixture to the conduit inlet;

a control member slidably mounted within said mixing device and means for regulating the position of said control member in one of said openings of said mixing device whereby the proportionate amounts of gas and air reaching said mixing region first inlet is determined by the position of said control member.

22. The apparatus of claim 21 wherein said control member extends through said (first) inlet.

23. The apparatus of claim 21 wherein said control member is movable through said first inlet and is further movable to regulate the air flow entering said second inlet.

24. The apparatus of claim 21 wherein said control member comprises an elongated rod and said means for operating said control member comprises a piston slidably mounted within a cylinder, said rod being joined to said piston;

resilient bias means for normally urging said piston in a first direction;

said cylinder having a control inlet for admitting air under pressure for urging said piston in a second direction against the force of said biasing means.

25. The apparatus of claim 24 further comprising washer means positioned between said piston and one end of said cylinder for limiting the depth of entry of said control member into said mixing device.

26. The apparatus of claim 21 wherein said mixing devices comprises a main passage for receiving gas at a first inlet and delivering gas to said outlet end;

a branch passage communicating with said main passage and receiving air at its second inlet for delivery to said main passage;

said control member being an elongated member movable within said main passage;

the shape of said main passage being nonuniform such that a change in position of said control member alters the flow of gas through said main passage.

27. The apparatus of claim 26 wherein the control member is movable to a position in said main passage to alter the flow of air from said branch passage into said main passage.

28. Apparatus for improving the uniformity and percent of moisture content across a web undergoing drying comprising:

a plurality of elongated dryer units arranged transverse to the direction of movement of the web and each comprised of a plurality of dryer sections, each dryer section arranged to dry a particular section of the web;

each dryer section comprising a radiant energy emitter and means for receiving an air/gas mixture for heating the emitter when ignited, the proportion of which mixture controls the radiant energy output level of the associated dryer section;

regulating means for selectively regulating the air/gas mixture for each dryer section between predetermined upper and lower energy levels, said lower energy level being at least sufficient to sustain combustion of the air/gas mixture;

means for individually operating said regulating means to control drying across each of said dryer units to provide localized drying at a selected one of said upper and lower energy levels of any desired longitudinal section of the moving web, the amount of localized drying being the cumulative sum of the individual dryer sections of said dryer units for drying a section of the web to thereby achieve a more uniform moisture distribution across the web.

29. The apparatus of claim 21 wherein said control member is movable to a first position to provide a large opening for passage of gas therethrough and movable to a second position to provide a restricted opening for restricted passage of gas therethrough.

30. Apparatus for regulating an air/gas mixture delivered to a combustion chamber comprising:

a conduit having a first inlet for receiving an air/gas mixture and an outlet, said conduit delivering the air/gas mixture entering said inlet to said outlet;

said outlet communicating with said combustion chamber;

a mixing device having a first inlet for receiving gas, a second inlet for receiving air and a mixing region for mixing said air and gas and delivering the mixture to the conduit inlet;

a control member movably mounted within said conduit and means for moving said control member to a first position to provide a large opening for passage of gas therethrough and to a second position to provide a restricted opening for passage of gas therethrough.

31. The apparatus of claim 15 wherein said dryer sections are infrared emitters.

32. The apparatus of claim 31 wherein said emitters are adjusted to operate at a wavelength in the range between 1.9 to 1.95 microns when operating at said high intensity level.

33. The apparatus of claim 32 wherein the emitters of at least one of said drying means is operating at said high intensity level.

34. The apparatus of claim 28, wherein the air/gas mixture at said upper energy level is selected to operate the radiant energy emitter within a wavelength range selected to assure maximum infrared absorption by the web.

35. The apparatus of claim 34, wherein the range of said wavelength region is from 1.90 to 1.95 microns.

36. The apparatus of claim 34, wherein the emitters of at least one of said dryer units are operated at said upper energy level.

37. The apparatus of claim 28, wherein the upper energy level of the dryer sections in at least one of the said dryer units is different from the upper energy level of the dryer sections of the remaining dryer units.

38. The apparatus of claim 28, wherein said regulating means maintains the dryer section of one of said dryer units initially at said lower energy level, said regulating means periodically switching selecting ones of the dryer sections of said one of said dryer units in a manner to obtain the desired uniformity of moisture content across the web.

* * * * *

UNITED STATES PATENT AND TRADEMARK OFFICE

CERTIFICATE OF CORRECTION

PATENT NO. : 4,498,864

DATED : February 12, 1985

INVENTOR(S) : Reinhold C. Roth; Richard F. Terra

It is certified that error appears in the above-identified patent and that said Letters Patent is hereby corrected as shown below:

Column 6 line 46 change "exterior" to --interior--.

Column 8 line 31 change "W" to --$W_1$--.

Signed and Sealed this

*Eleventh* Day of *June 1985*

[SEAL]

*Attest:*

DONALD J. QUIGG

*Attesting Officer* *Acting Commissioner of Patents and Trademarks*